US006871721B2

(12) United States Patent
Smiley et al.

(10) Patent No.: US 6,871,721 B2
(45) Date of Patent: Mar. 29, 2005

(54) ERGONOMIC OPERATOR COMPARTMENT FOR OPERATORS OF DIFFERING HEIGHTS

(75) Inventors: Gregory W. Smiley, Greene, NY (US); H. Scott Ryan, Skaneatetes, NY (US); Kurt R. Werner, Auburn, NY (US)

(73) Assignee: The Raymond Corporation, Greene, NY (US)

( * ) Notice: Subject to any disclaimer, the term of this patent is extended or adjusted under 35 U.S.C. 154(b) by 0 days.

(21) Appl. No.: 10/453,170

(22) Filed: Jun. 3, 2003

(65) Prior Publication Data

US 2004/0245038 A1 Dec. 9, 2004

(51) Int. Cl.[7] ..... B62D 33/06

(52) U.S. Cl. ..... 180/333; 180/89.12; 296/153; 296/190.01; 187/224

(58) Field of Search ..... 180/333, 89.12; 296/190.01, 190.08, 153; 187/224, 222; 297/411.22

(56) References Cited

U.S. PATENT DOCUMENTS 2,068,505 A 1/1937 Morrison
2,276,020 A * 3/1942 Chlpka ..... 296/153
4,702,520 A * 10/1987 Whisler et al. ..... 297/411.36
4,730,867 A 3/1988 Cluba
4,810,026 A * 3/1989 Doane ..... 296/153
4,890,878 A * 1/1990 Harary et al. ..... 296/153
4,895,039 A * 1/1990 Hegg ..... 74/471 XY
4,895,040 A * 1/1990 Soederberg ..... 74/491
4,907,835 A 3/1990 Salters
5,921,610 A * 7/1999 Grimes ..... 296/153
6,189,964 B1 * 2/2001 Henshaw et al. ..... 297/112
6,397,961 B1 * 6/2002 Sutton ..... 180/65.1
6,612,636 B2 * 9/2003 Arthur et al. ..... 296/71
6,675,508 B2 * 1/2004 Tamaru et al. ..... 37/348

FOREIGN PATENT DOCUMENTS

EP 1288063 A2 * 3/2003
JP 10-87292 * 4/1998

* cited by examiner

*Primary Examiner*—Paul N. Dickson
*Assistant Examiner*—George D. Spisich
(74) *Attorney, Agent, or Firm*—Quarles & Brady LLP

(57) ABSTRACT

An operator station for a lift truck or other vehicle including a scalloped arm rest providing a plurality of arm rest positions for operators of varying sizes. The arm rests are positioned approximate an operator control handle, such that operators can operate vehicle controls while resting their arms in a selected one of the scalloped arm rests.

21 Claims, 4 Drawing Sheets

ERGONOMIC OPERATOR COMPARTMENT FOR OPERATORS OF DIFFERING HEIGHTS

BACKGROUND OF THE INVENTION

The present invention relates to material handling vehicles, and more particularly to an ergonomically improved operator compartment for use in a material handling vehicle.

The operation of a forklift or other material handling vehicle requires the manipulation of an array of controls, levers, wheels, and switches for driving the vehicle forward and backward, steering the vehicle, and raising and lowering the forks, among other things. Due to the variety of control devices, operator compartments are frequently crowded with a variety of disparate controls, and these controls are typically located throughout the compartment, albeit within the reach of the operator.

To assure efficiency of use of the material handling vehicle, it is important that the controls be arranged ergonomically, such that the operator can easily reach and activate the controls with a minimal amount of movement. An ergonomic arrangement is important not only for maintaining the comfort of the operator, but also to maximize use of the vehicle by limiting the number of breaks that the operator needs to rest their hands, feet and/or back, which can become tired due to repetitive motions. By improving the comfort of the operator compartment, the need for operator down time can be reduced, thereby improving the overall efficiency of the vehicle.

To improve the ergonomics of the operator compartment, it is known to provide controls as part of or near the arm rests of the compartment, where they are within easy reach of the operator even while the arms of the operator are at rest. Positioning the controls on or near arm rests generally improves the ergonomics of the operator compartment. However, these arm rest arrangements are typically provided in a single size and height level, which is dimensioned to meet the needs of individual operators which fall within a predetermined "average" size. It is, however, inconvenient to select operators based entirely on whether they fit within "average" size guidelines, and can therefore be comfortably fitted into the operator compartment. Alternatively, adjustable arm rests can be provided. Adjustable rests, however, are time consuming, and, particularly when used frequently, have a tendency to break or fail. Furthermore, these arrangements require re-adjustment whenever an operator is changed, decreasing the overall efficiency of the vehicle. It is desirable, therefore, for the operator compartment to be sized in such a way that adult operators of all sizes can be made reasonably comfortable, thereby increasing the overall efficiency of the vehicle by allowing it to be comfortably operated by virtually any employee.

There remains a need, therefore, for an ergonomic operator compartment for use in a material handling vehicle such as a forklift or reach truck design.

SUMMARY OF THE INVENTION

In one aspect, the present invention is an ergonomic vehicle compartment comprising a compartment floor surface, and compartment walls extending above and at least partially enclosing the compartment floor surface. A plurality of concave depressions are formed in the compartment walls, at a succession of different heights above the compartment floor surface, each concave depression being positioned and shaped to receive and support the arm of a vehicle passenger having a height in a selected range, such that vehicle passengers of different heights may elect to use the one of said plurality of concave depressions that is most comfortable. A width of each of the arm rests can be selected based on a statistical width of an arm associated with a selected height. Furthermore, the concave depressions can be found proximate an operator control.

In another aspect, the present invention is an operator station for a vehicle, including a platform and an enclosure surrounding at least a portion of the platform. An operator control is mounted to the enclosure, and a first and a second arm rests are formed in a substantially parallel configuration in a top portion of the enclosure at a first and a second height, respectively. The first arm rest is formed in the enclosure at a location which enables an operator grasping the operator control to rest a forearm on a contoured surface of the enclosure, and a second arm rest is formed in the enclosure at a location adjacent the first arm rest and having a contoured surface for resting an operator forearm at a different height above the platform than the first arm rest contoured surface.

In yet another aspect, the present invention provides a lift truck, including a fork, an operator station from which the operator drives the lift truck, a steering mechanism for selecting a direction of travel, an operator control providing a plurality of operator control functions for controlling the motion of the lift truck and the forks, and a traction system for driving the truck. The operator station is at least partially surrounded by an enclosure, and the steering mechanism and operator control are mounted on a top portion of the enclosure. A plurality of concave depressions are formed in the compartment walls, at a succession of different heights above the compartment floor surface, each concave depression being positioned and shaped to receive and support the arm of a vehicle operator having a height in a selected range. Therefore, vehicle operators of different heights may elect to use the one of said plurality of concave depressions that is most comfortable.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE PREFERRED EMBODIMENT

Figure 1:
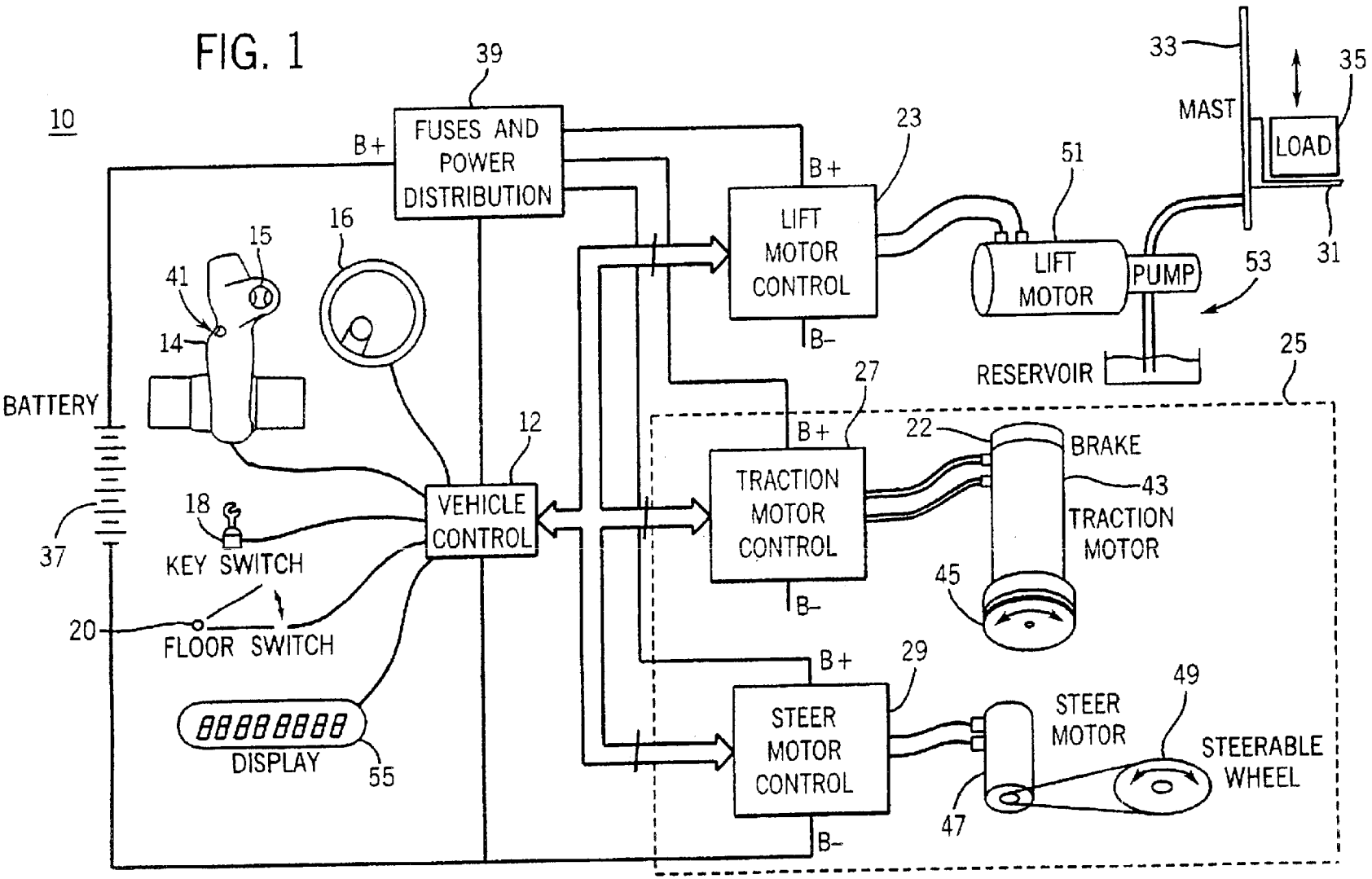
FIG. 1 is a block diagram of a material handling vehicle or lift truck in which the present invention can be provided.

Referring now to FIG. 1, a block diagram of a typical lift truck 10 in which the present invention can be provided is illustrated. The lift truck 10 comprises a vehicle control system 12 which receives operator input signals from an operator control handle 14, a steer wheel 16, a key switch 18, and a floor switch 20 and, based on the received signals, provides command signals to each of a lift motor control 23 and a drive system 25 including both a traction motor control 27 and a steer motor control 29. The drive system provides a motive force for driving the lift truck 10 in a selected direction, while the lift motor control 23 drives forks 31 along a mast 33 to raise or lower a load 35, as described below. The lift truck 10 and vehicle control system 12 are powered by one or more battery 37, coupled to the vehicle control system 12, drive system 25, steer motor control 29, and lift motor control 23 through a bank of fuses or circuit breakers 39.

As noted above the operator inputs include a key switch 18, floor switch 20, steering wheel 16, and an operator control handle 14. The key switch 18 is activated to apply power to the vehicle control system 12, thereby enabling the lift truck 10. The floor switch 20 provides a deadman braking device, disabling motion of the vehicle unless the floor switch 20 is activated by the operator, as described below. The operator control handle 14 provides a number of functions. Typically, the handle 14 is rotated in a vertical plane to provide a travel direction and speed command of motion for the lift truck 10. A four-way switch 15 located on the top of the handle 14 provides a tilt up/down function when activated in the forward and reverse directions and a sideshift right and left function when activated to the right and left directions. A plurality of control actuators 41 located on the handle 14 provide a number of additional functions, and can include, for example, a reach push button, a retract push button, and a horn push button as well as a potentiometer providing a lift function. A number of other functions could also be provided, depending on the construction and intended use of the lift truck 10.

The traction motor control 27 drives one or more traction motor 43 which is connected to wheel 45 to provide motive force to the lift truck. The speed and direction of the traction motor 43 and associated wheel is selected by the operator from the operator control handle 14, and is typically monitored and controlled through feedback provided by an encoder or other feedback device coupled to the traction motor 43. The wheel 45 is also connected to friction brake 22 through the drive motor, providing both a service and parking brake function for the lift truck 10. The friction brake 22 is typically spring-activated, and defaults to a "brake on" position. The operator must provide a signal indicating that the brake is to be released, here provided by the floor switch 20, as described above. The traction motor 43 is typically an electric motor, and the associated friction brakes 22 can be either electrically operated or hydraulically operated devices. Although one friction brake 22, motor 43, and wheel 45 are shown, the lift truck 10 can include one or more of these elements.

The steer motor control 29 is connected to drive a steer motor 47 and associated steerable wheel 49 in a direction selected by the operator by rotating the steering wheel 16, described above. The direction of rotation of the steerable wheel 49 determines the direction of motion of the lift truck.

The lift motor control 33 provides command signals to control a lift motor 51 which is connected to a hydraulic circuit 53 for driving the forks 31 along the mast 33, thereby moving the load 35 up or down, depending on the direction selected at the control handle 14. In some applications, the mast 33 can be a telescoping mast. Here, additional hydraulic circuitry is provided to raise or lower the mast 33 as well as the forks 31.

In addition to providing control signals to the drive system and lift control system, the vehicle control 12 can also provide data to a display 55 for providing information to the operator. Displayed information can include, for example, a weight of a load placed on the forks 31, the speed of the vehicle, the time, or maintenance information.

Figure 2:
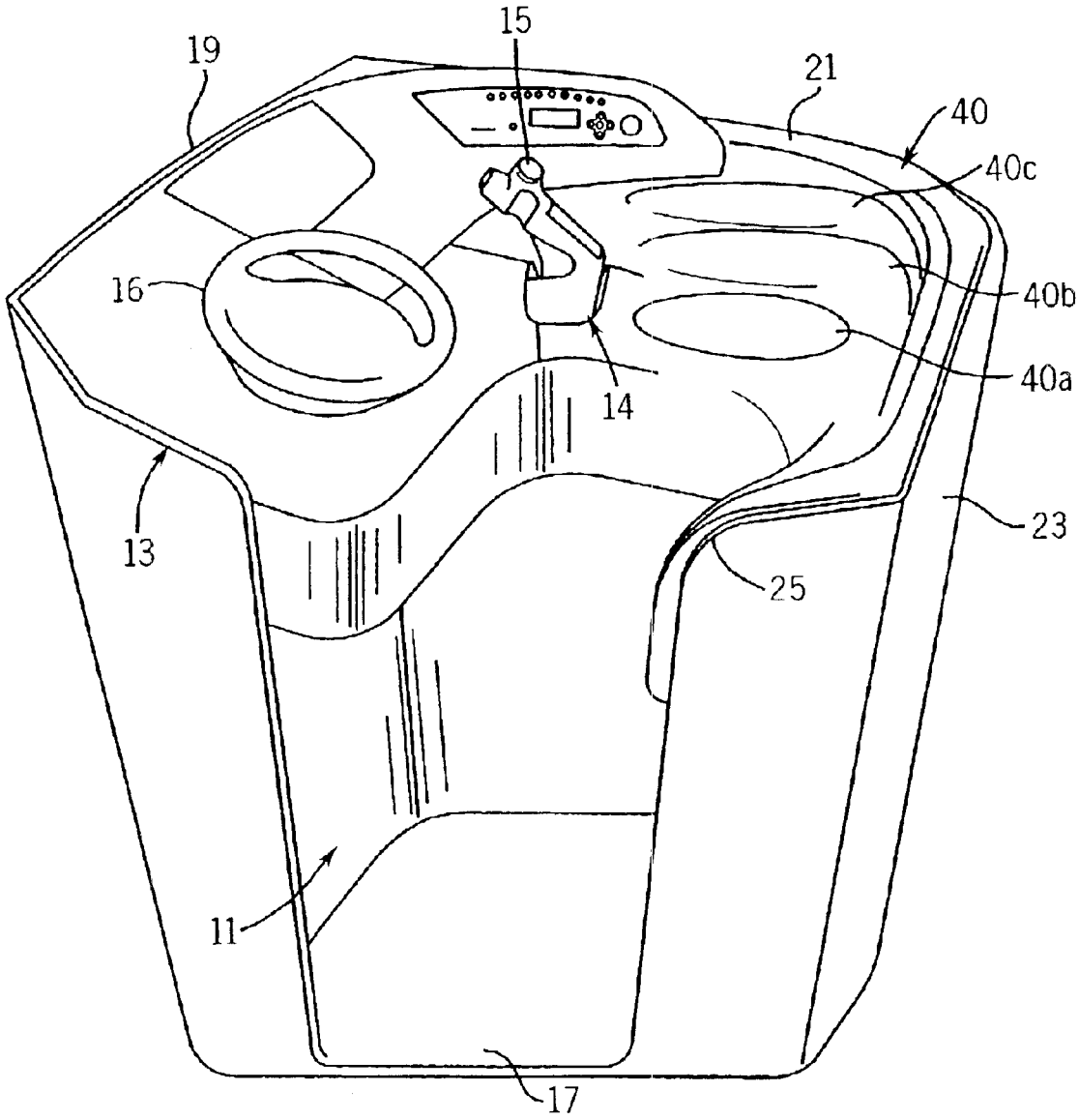
FIG. 2 is a perspective view of an operator compartment illustrating the scalloped arm rests of the present invention from a first angle.

As can be seen from the foregoing description, there are a number of varied controls which must be activated by the operator to control the lift truck 10. Referring now to FIG. 2, a perspective view of the lift truck 10 illustrating an operator station comprising an operator station or compartment 11 constructed in accordance with the present invention is shown. The operator compartment 11 includes a platform 17 on which the operator stands and a plurality of walls 19, 21, 23, 25, enclosing the compartment. At least a portion of one of the walls 25 is discontinuous to provide an entryway for the operator. An operator console 13 is provided along an upper portion of the enclosure. Operator console 13 contains openings which define the locations of the control handle 14 and steering wheel 16, within reach of the operator." (The control handle and steering wheel are not mounted to the console directly). In typical fork lift configurations, the operator console 13 is provided adjacent the forks 31 such that the operator looks forward toward the forks 31 while operating the vehicle 10. Here, as shown, the operator compartment 11 is provided in a "side stance" configuration. In this configuration, the operator control console 12 is provided on a side of the operator compartment 11, extending between the open back end of the compartment 11 and the forks 31. The ergonomic improvements of the present invention can be provided in either of these or other configurations, including those in which the operator is either sitting or standing.

Figure 3:
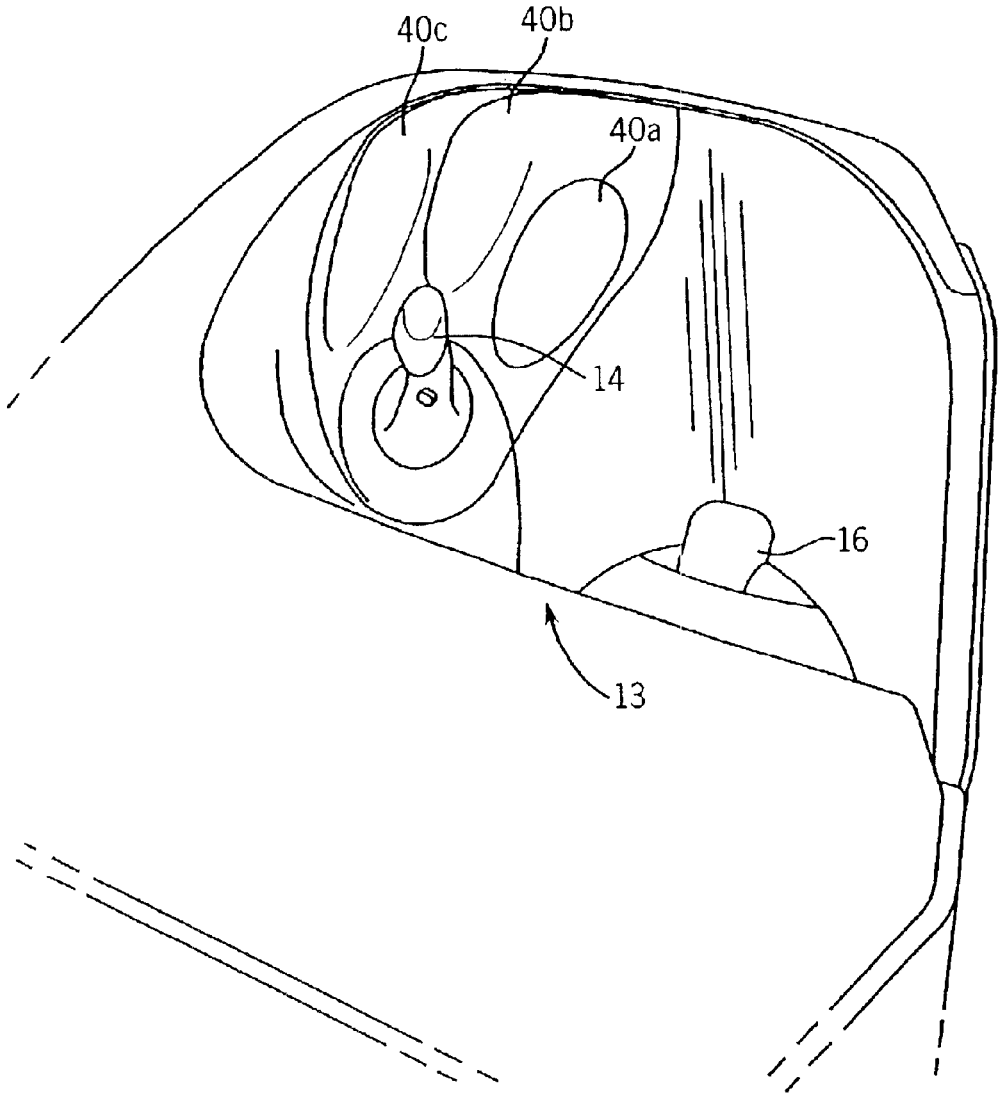
FIG. 3 is a perspective view of the operator compartment illustrating the scalloped arm rests of the present invention from a second angle.

Referring now to FIGS. 2 and 3, during operation of the truck 10, the operator stands on the platform 17 in the operator compartment 11 immediately behind the operator console 13, thereby allowing easy access to the controls, which include the control handle 14 and steering wheel 16. An arm rest 40 is provided adjacent the control handle 14, and extends along a wall of the compartment 11 substantially parallel to the side of the operator compartment 11 adjacent the forks. The arm rest 40 is sculptured or "scalloped" to provide three separate concave arm rest locations 40*a*, 40*b*, and 40*c*, each of the arm rest locations being sized and dimensioned to provide a comfortable resting position for an operator at a selected size range, as described below. The arm rest locations 40*a*, 40*b*, and 40*c* are arranged at varying heights and are further sized and dimensioned for arms of varying lengths and widths, the highest arm rest 40*c* being longer and wider than the arm rests 40*b* and 40*c*, as the arms of taller individuals are statistically more likely to be longer. The rests 40*b* and 40*c* are, similarly, successively shorter as they drop in height. The arm rests 40*a*, 40*b*, and 40*c* are further angled to direct the arm of the operator at the operator control 14 when positioned in the appropriate rest 40*a*, 40*b*, or 40*c*. With a first arm positioned in the arm rest 40, the opposing arm of the operator is positioned within reach of the steering wheel 16. Therefore, the operator can comfortably control both the steering wheel 16 and control handle 14 from the rest position.

Figure 4:
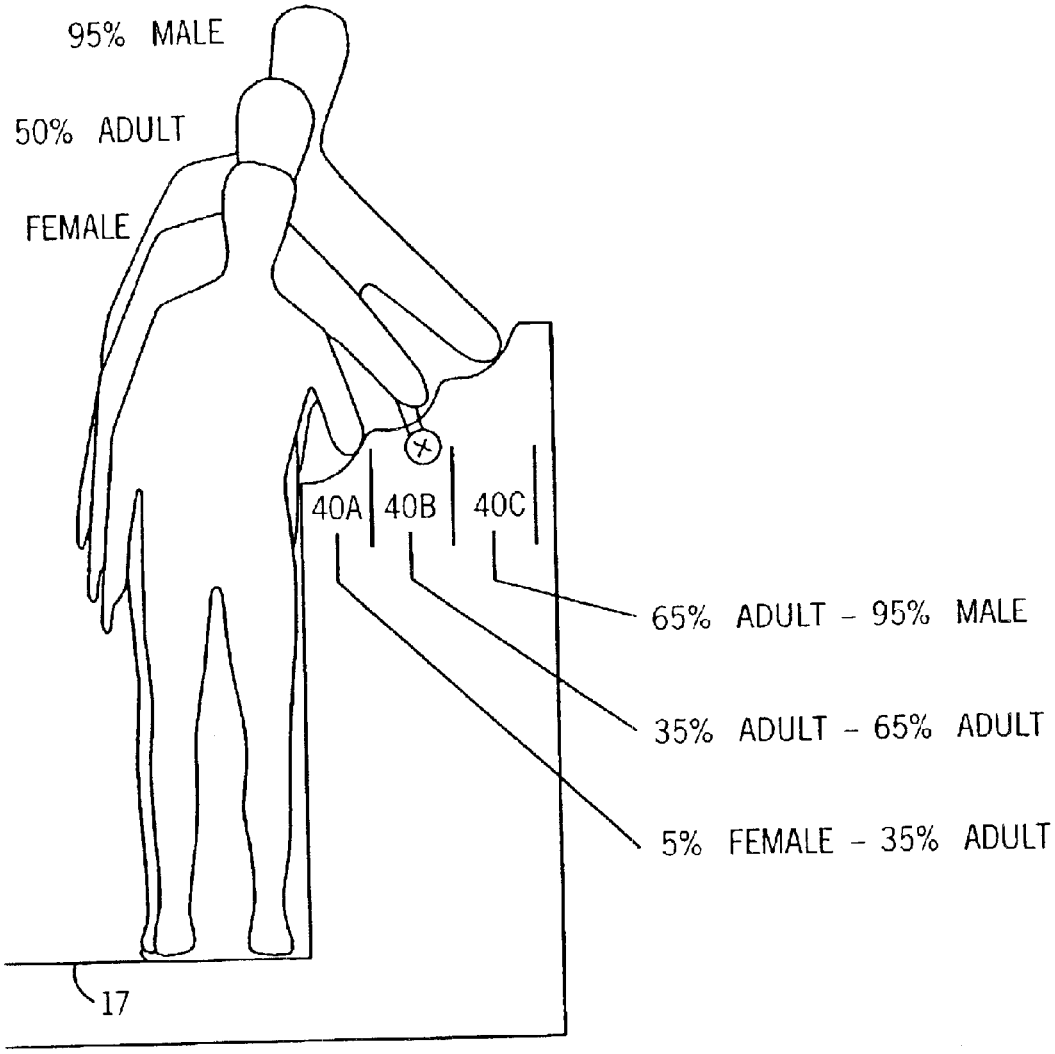
FIG. 4 is cutaway view of a compartment illustrating operators of varying heights using the arm rests.

Referring now to FIG. 4, a cutaway view of the operator compartment 11 illustrating the related positions of the arm rest 40*a*, 40*b*, and 40*c* is shown. The shortest arm rest 40*a* is positioned at a height of between approximately 39 inches and 41 inches and has a width of about three inches, the middle arm rest 40*b* is positioned at a height between approximately 41 and 43 inches and has a width of approximately three and a quarter inches, and the highest 40*c* is positioned at a height between approximately 42 and 45.5 inches and has a width of approximately four inches. These height and width positions are selected based on statistical data available from industry ergonomic standards, here the Dreyfuss standard, although similar standard could also be used. The lowest arm rest 40*a* is selected to provide a comfortable fit for a range of operators extending from 5% of the female population to 35% of the adult population; the middle rest 40*b* to comfortably fit 35%–65% of the adult population; and the highest arm rest 40*c* to comfortably fit 65% of adults-95% of the male population. Based on these selected positions, the operator compartment 11 can comfortably fit all but the shortest 5% of the female population, and the tallest 5% of the male population, and therefore can be comfortably operated by a high percentage of the adult population, without the need for adjustments or modifications within the operator compartment 11.

The scalloped arm rests 40*a*, 40*b*, and 40*c* can be constructed in a number of ways. The arm rests 40*a*, 40*b*, and 40*c* can, for example, be constructed of foam in which the scallops are formed in the top surface. Alternatively, the scalloped arm rest 40*a*, 40*b*, and 40*c* can be molded or provided as part of a sheet of foam material formed over a scallop-shaped substrate. Other methods for molding the scalloped arm rests 40*a*, 40*b*, and 40*c* into the compartment 13 will be apparent to those of skill in the art.

Although a configuration including three arm rests is shown, it will be apparent that any number of two or more arm rests could be provided to improve over existing single arm rest systems. Furthermore, although the arm rests are shown molded directly into the operator compartment, the arm rests could also be separately provided and attached or adhered to the compartment.

Although the invention has been described specifically for use in a lift truck or material handling vehicle, it will be apparent that the arm rest can be useful in any number of vehicles or in stationary seating arrangements. As noted above, the described arm rests can be applied to vehicles in which 2 operators or passengers sit or stand. Furthermore, the size and angle of the arm rest configuration can be modified for the expected application.

It should be understood that the methods and apparatuses described above are only exemplary and do not limit the scope of the invention, and that various modifications could be made by those skilled in the art that would fall under the scope of the invention. To apprise the public of the scope of this invention, the following claims are made:

We claim:

1. An operator station for a vehicle, the operator station comprising:

a platform;

an enclosure surrounding at least a portion of the platform;

an operator control mounted to the enclosure;

a first arm rest formed in the enclosure at a location which enables an operator grasping the operator control to rest a forearm on a contoured surface thereof; and a second arm rest formed in the enclosure at a location adjacent the first arm rest and having a contoured surface for resting an operator forearm at a different height above the platform than the first arm rest contoured surface, and wherein the lower of the first and second arm rest is dimensioned to be smaller than the higher of the first and second arm rests.

2. The operator station as defined in claim 1, wherein the first and second arm rests are molded into the enclosure.

3. The operator station as defined in claim 1, wherein the first arm rest is positioned nearer the platform than the second arm rest.

4. The operator station as defined in claim 1, wherein the first and second arm rests are scalloped into the enclosure.

5. The operator station as defined in claim 1, wherein the operator control is positioned proximate an end of each of the first and second arm rests.

6. The operator station as defined in claim 1, further comprising a third arm rest, the third arm rest being positioned in the enclosure parallel to the first and second arm rests, and being positioned at a third height.

7. The operator station as defined in claim 1, further comprising a steering wheel, the steering wheel being positioned in the enclosure in a position substantially opposite the first and second arm rests, wherein the steering wheel is operable by the arm of the operator that is not positionable in the first or second arm rest.

8. The operator station as defined in claim 1, wherein the first and second arm rests comprise concave depressions in the enclosure.

9. The operator station as defined in claim 1, wherein at least a top portion of the enclosure comprises a foam material, and wherein the arm rests are formed into the foam material.

10. The operator station as defined in claim 1, wherein the first and second arm rests are formed in a sheet material provided on the enclosure.

11. A lift truck, comprising:

a fork;

an operator station from which the operator drives the lift truck, the operator station being at least partially surrounded by an enclosure;

a steering mechanism mounted for access on the enclosure, the steering mechanism being controlled by the operator to select a direction of motion;

an operator control mounted for access on the enclosure, the operator control providing a plurality of operator control functions for controlling the motion of the lift truck and the forks;

a traction system controlled by the operator to drive the lift truck in a selected direction;

a plurality of concave arm rests formed in a top portion of the enclosure, at different heights, each of the plurality of arm rests being positioned and shaped to receive an arm of an operator gripping the operator control.

12. The lift truck as defined in claim 11, wherein the plurality of arm rests are positioned at successive heights and shaped at successively increasing sizes to accommodate operators in successively increasing height ranges.

13. The lift truck as defined in claim 11, wherein the top portion of the enclosure comprises a foam, and the arm rests are formed into the foam.

14. The lift truck as defined in claim 11, wherein successive ones of the plurality of arm rests are positioned higher on the enclosure, from a first low arm rest provided at a first operator height range to a last high arm rest provided at a second operator height range higher than the first operator height range.

15. The lift truck as defined in claim 14, wherein the low arm rest is shorter in length than the high arm rest.

16. The lift truck as defined in claim 11, further comprising a sheet metal provided on the top portion of the enclosure, wherein the plurality of arm rests are formed in the sheet metal.

17. The lift truck as defined in claim 11, wherein the plurality of arm rests comprises a short arm rest provided at a first height and sized and dimensioned for statistically short operators, a medium arm rest provided at a second height higher than the first height and sized and dimensioned for statistically medium-height operators, and a tall arm rest provided at a third height higher than the second height and sized and dimensioned for statistically tall operators.

18. The lift truck as defined in claim 11, wherein the plurality of arm rests are scalloped into the side of the enclosure.

19. An ergonomic vehicle compartment, comprising:

a compartment floor surface;

compartment walls extending above and at least partially enclosing the compartment floor surface;

a plurality of concave depressions fanned in the compartment walls, at a succession of increasing heights above the compartment floor surface, the concave depressions being of correspondingly increasing size to receive and support the arm of a vehicle operator having a height in a selected range;

wherein vehicle operators of different heights may elect to use the one of said plurality of concave depressions that is most comfortable.

20. The vehicle compartment as defined in claim 19, wherein a width of each of the arm rests is selected based on a statistical width of an arm associated with the selected height.

21. The vehicle compartment as defined in claim 19, wherein the concave depressions are found proximate an operator control.

* * * * *

UNITED STATES PATENT AND TRADEMARK OFFICE

CERTIFICATE OF CORRECTION

PATENT NO. : 6,871,721 B2
DATED : March 29, 2005
INVENTOR(S) : Gregory W. Smiley et al.

It is certified that error appears in the above-identified patent and that said Letters Patent is hereby corrected as shown below:

Column 7,
Line 14, "fanned" should be -- formed --.

Signed and Sealed this

Nineteenth Day of July, 2005

JON W. DUDAS
*Director of the United States Patent and Trademark Office*